US008176817B2

(12) United States Patent
Liu

(10) Patent No.: US 8,176,817 B2
(45) Date of Patent: May 15, 2012

(54) TOOL COUPLING STRUCTURE

(76) Inventor: Kuo-Han Liu, Taiping (TW)

( * ) Notice: Subject to any disclaimer, the term of this patent is extended or adjusted under 35 U.S.C. 154(b) by 331 days.

(21) Appl. No.: 12/684,935

(22) Filed: Jan. 9, 2010

(65) Prior Publication Data

US 2011/0167966 A1 Jul. 14, 2011

(51) Int. Cl.
*B25B 23/16* (2006.01)
*B25G 1/00* (2006.01)

(52) U.S. Cl. ..... 81/177.75; 81/177.85

(58) Field of Classification Search ..... 81/177.75, 81/177.85, 177.7, 124.5, 177.8
See application file for complete search history.

(56) References Cited

U.S. PATENT DOCUMENTS

| | | | | |
|---|---|---|---|---|
| 5,738,586 | A * | 4/1998 | Arriaga | 464/106 |
| 7,278,342 | B1 * | 10/2007 | Chang | 81/177.75 |
| 7,430,943 | B2 * | 10/2008 | Chiang | 81/177.7 |
| 7,966,915 | B2 * | 6/2011 | Chen | 81/177.75 |
| 2007/0107564 | A1 * | 5/2007 | Chang | 81/177.75 |
| 2007/0144313 | A1 * | 6/2007 | Chang | 81/177.75 |
| 2009/0288523 | A1 * | 11/2009 | Chen | 81/177.85 |

* cited by examiner

*Primary Examiner* — David B Thomas

(57) ABSTRACT

A tool coupling structure comprises a first post member including a fitting end disposed on one end thereof and a polygonal cavity mounted on another end thereof; the cavity including a hole formed on an outer wall thereof, and the hole including a biasing element installed therein; a second post member including a coupling end fixed on one end thereof and a polygonal sphere knob formed on another end thereof to be fitted to the cavity of the fist post member, and the sphere knob including an elastic engaging member fixed on a peripheral side thereof in response to the hole of the first post member to be retained in the hole.

9 Claims, 13 Drawing Sheets

TOOL COUPLING STRUCTURE

BACKGROUND OF THE INVENTION

1. Field of the Invention

The present invention relates to a tool coupling structure that is capable of obtaining secure locking function and rotate thing the sphere knob to a desired angle easily.

2. Description of the Prior Arts

As shown in FIGS. 1 and 2, a conventional tool coupling structure disclosed in TW Pat. No. 98201746 includes a shank 10, an operating member 20, and a limiting structure 30, wherein the shank 10 includes a polygonal sphere knob 12 and a peripheral side 13 disposed on one end thereof, and includes a driving end 11 driven by a driving device, and the sphere knob 12 includes an orifice mounted on a largest diameter portion thereof to receive a biasing element 15 pushed by a resilient element 14 so that the biasing element 15 moves to the orifice; the operating member 20 includes a polygonal cavity 21 fixed on one end thereof and an operating tool fitted on another end thereof, the cavity 21 includes a retaining recess 22 and an annular groove 23 secured on a suitable portion thereof, and includes an annular abutting rim 24 arranged around an opening of thereof. The sphere knob 12 is fitted to the cavity 21 of the operating member 20, and the limiting structure 30 is provided in the annular groove 23 so that the sphere knob 12 of the shank 10 is retained in the cavity 21, and the sphere head 12 moves between a first and a second positions. As illustrated in FIG. 2, when the shank 10 is pressed to move toward the first position, because the peripheral side 13 of the shank 10 is fitted to the annular abutting rim 24 of the operating member 20, the shank 10 and the operating member 20 are coupled together linearly so that the driving device actuates the tool directly. As shown in FIG. 3, when the shank 10 is pulled to be located at the second position, due to the peripheral side 13 of the shank 10 disengages from the annular abutting rim 24 of the operating member 20, the shank 10 swings relative to the operating member 20 along the sphere knob 12 to be rotated at an angle, hence the tool can be used in a narrow space. Referring further to FIG. 2, even though the limiting structure 30 is provided to prevent the sphere knob 12 of the shank 10 from disengaging from the cavity 21 of the operating member 20, when the shank 10 is located at the first position, the biasing element 15 abuts against a defining slot 22 of the cavity 21, however the biasing element 15 and the defining slot 22 can not provide secure positioning function, hence when user rotates the driving device, the shank 10 moves to the second position easily to cause a danger.

The present invention has arisen to mitigate and/or obviate the afore-described disadvantages.

SUMMARY OF THE INVENTION

The primary object of the present invention is to provide a tool coupling structure that is capable of obtaining secure locking function.

Another object of the present invention is to provide a tool coupling structure that is capable of rotate thing the sphere knob to a desired angle easily.

In accordance with the present invention, there is provided a tool coupling structure comprising:

a first post member including a fitting end disposed on one end thereof and a polygonal cavity mounted on another end thereof; the cavity including a hole formed on an outer wall thereof, and the hole including a biasing element installed therein;

a second post member including a coupling end fixed on one end thereof and a polygonal sphere knob formed on another end thereof to be fitted to the cavity of the fist post member, and the sphere knob including an elastic engaging member fixed on a peripheral side thereof in response to the hole of the first post member to be retained in the hole.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
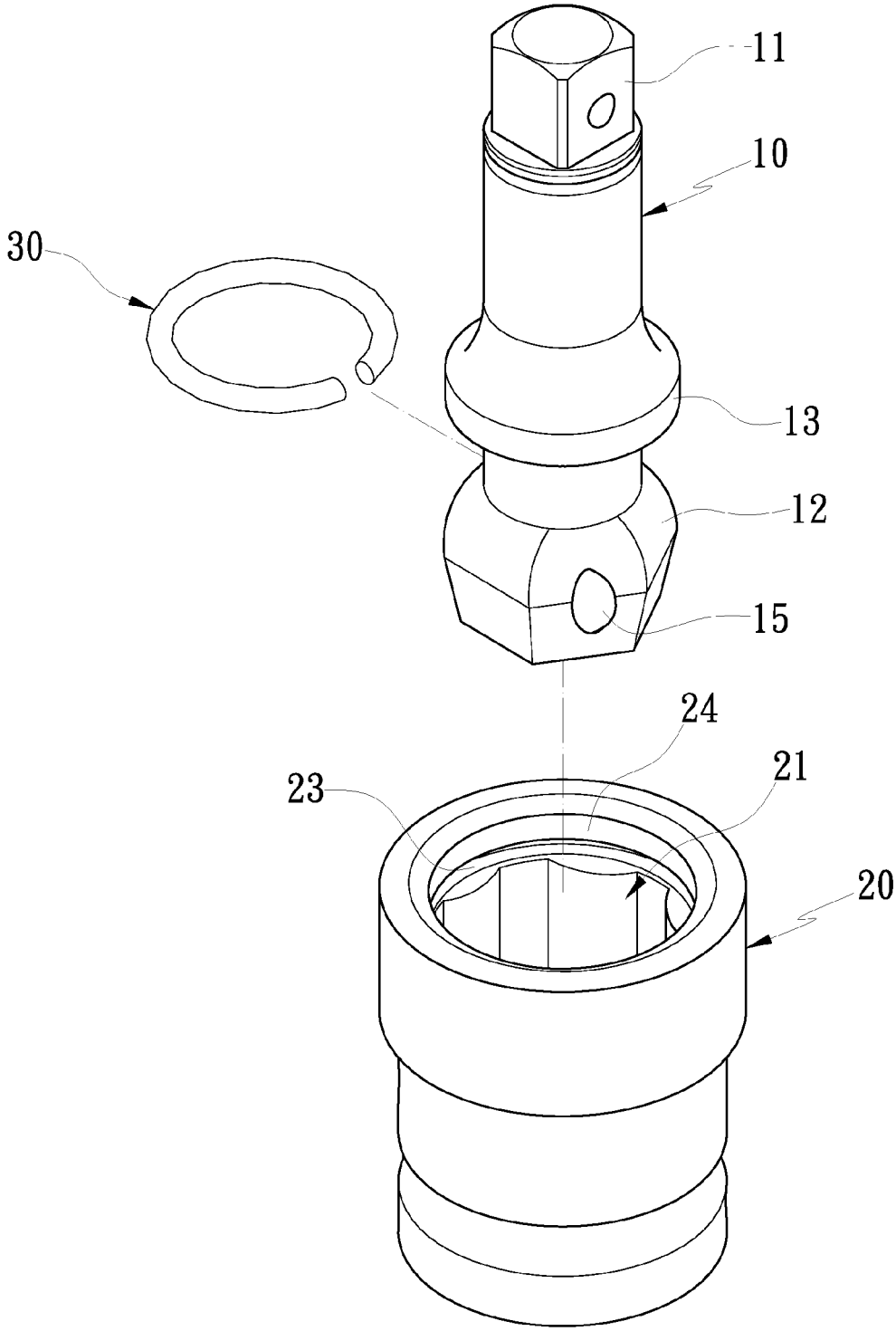
F I G . 1 PRIOR ART
FIG. 1 is a perspective view showing the exploded components of a conventional tool coupling structure of TW Pat. No. 98201746.
Figure 2:
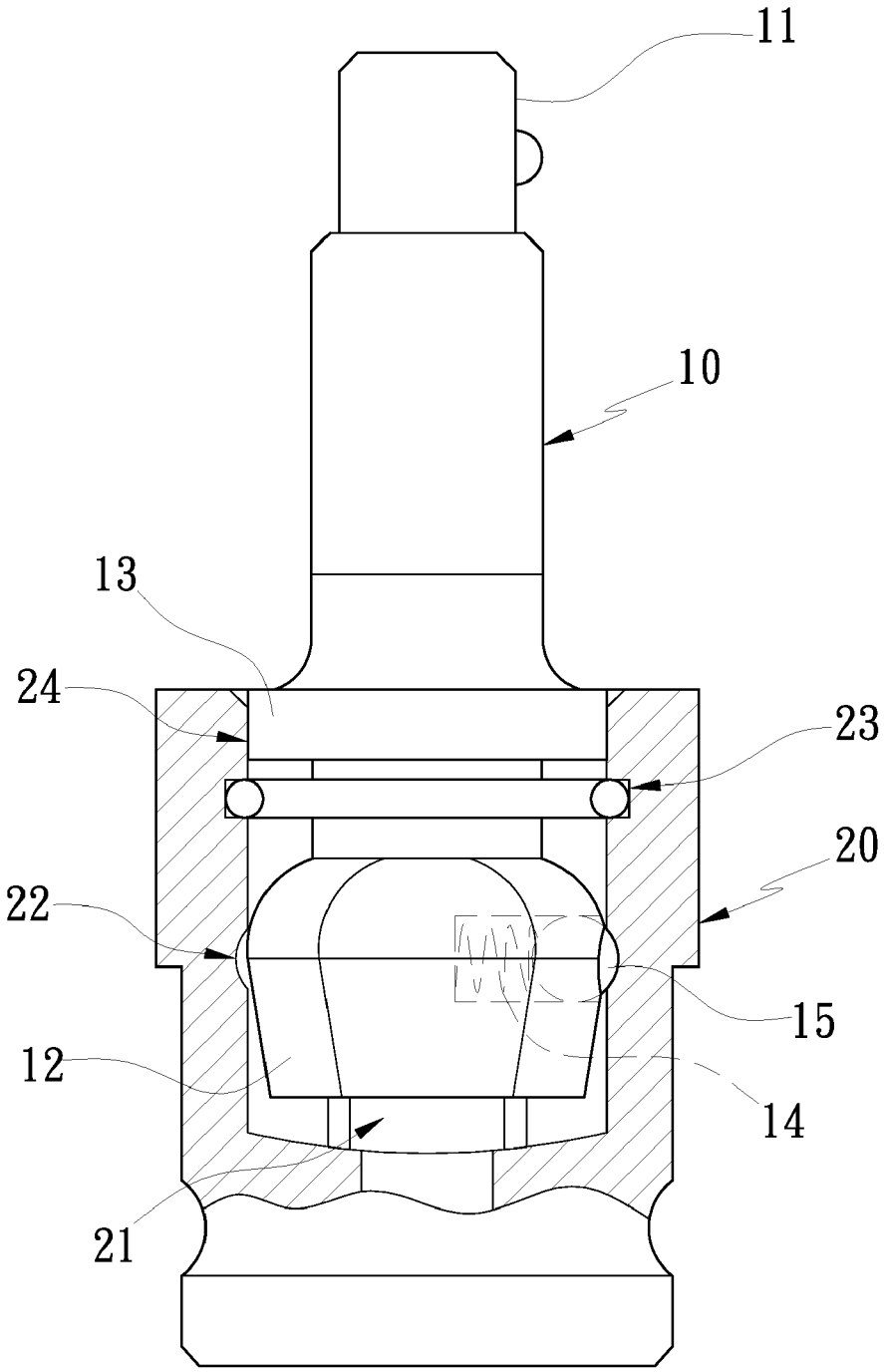
F I G . 2 PRIOR ART
FIG. 2 a cross sectional view showing the operations of the conventional tool coupling structure of TW Pat. No. 98201746.
Figure 3:
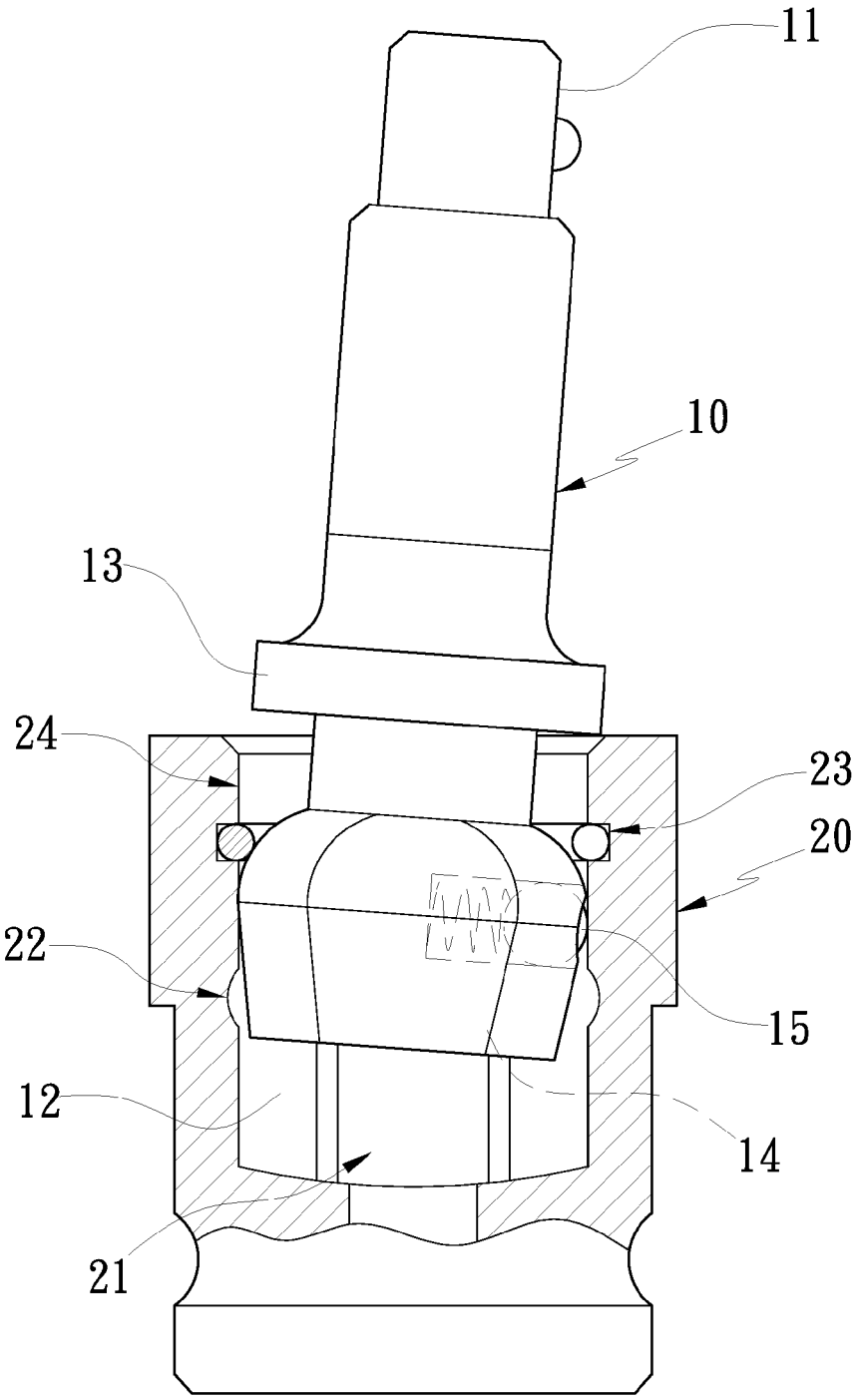
F I G . 3 PRIOR ART
FIG. 3 another cross sectional view showing the operations of the conventional tool coupling structure of TW Pat. No. 98201746.
Figure 4:
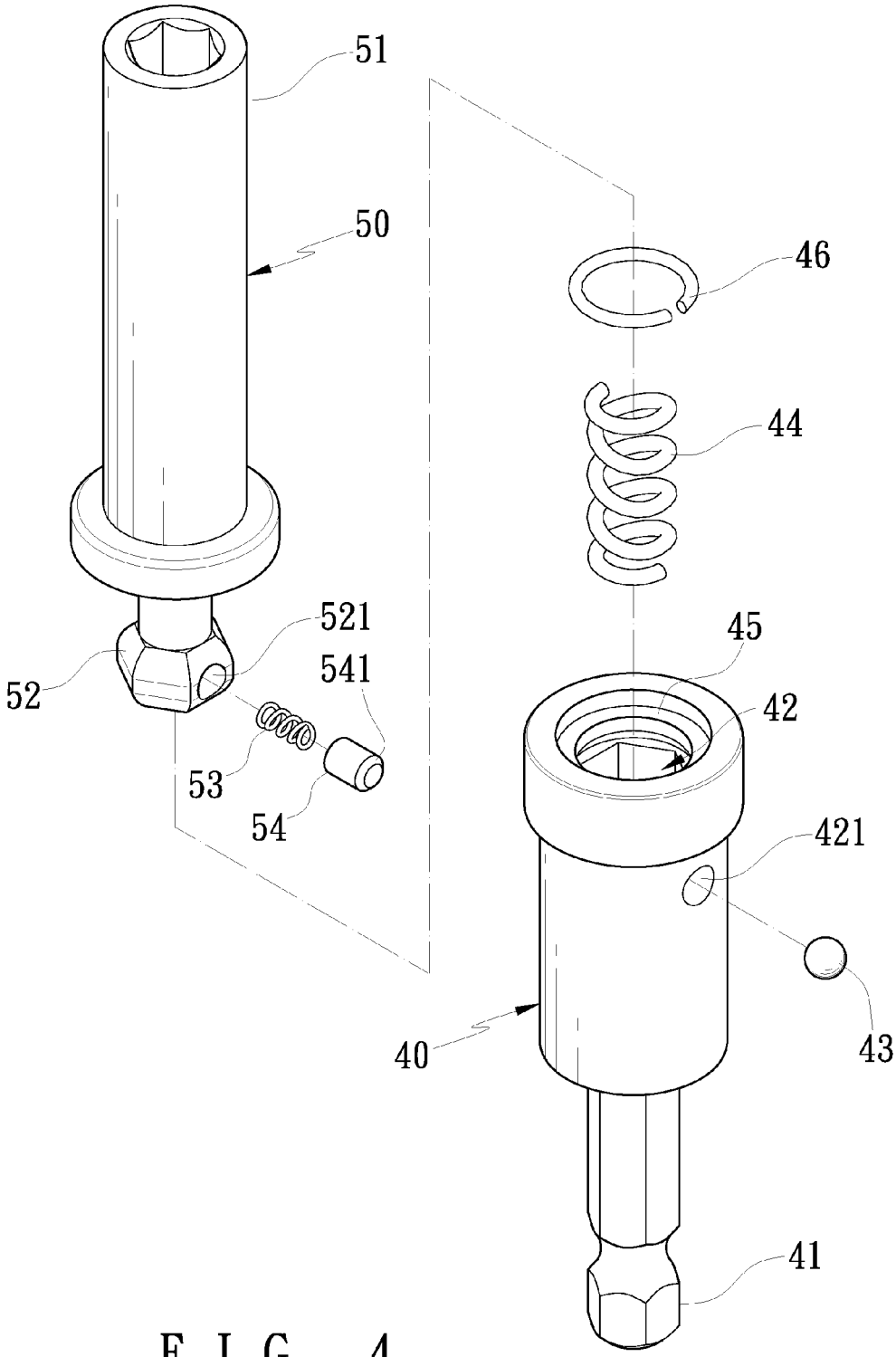
FIG. 4 is a perspective view showing the exploded components of a tool coupling structure according to a first embodiment of the present invention.
Figure 5:
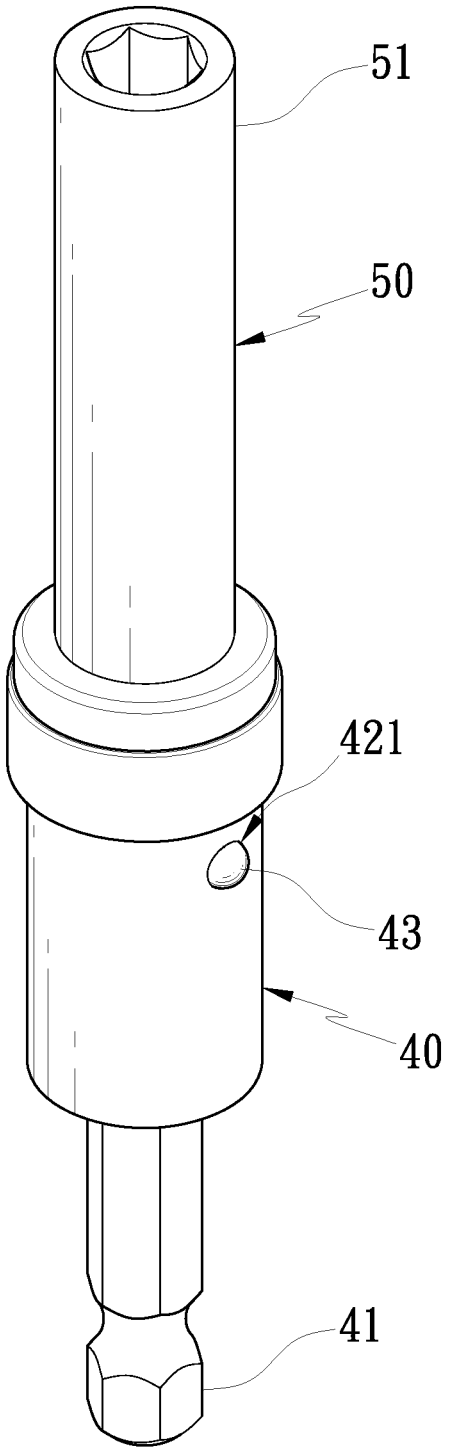
FIG. 5 is a perspective view showing the assembly of the tool coupling structure according to the first embodiment of the present invention.
Figure 6:
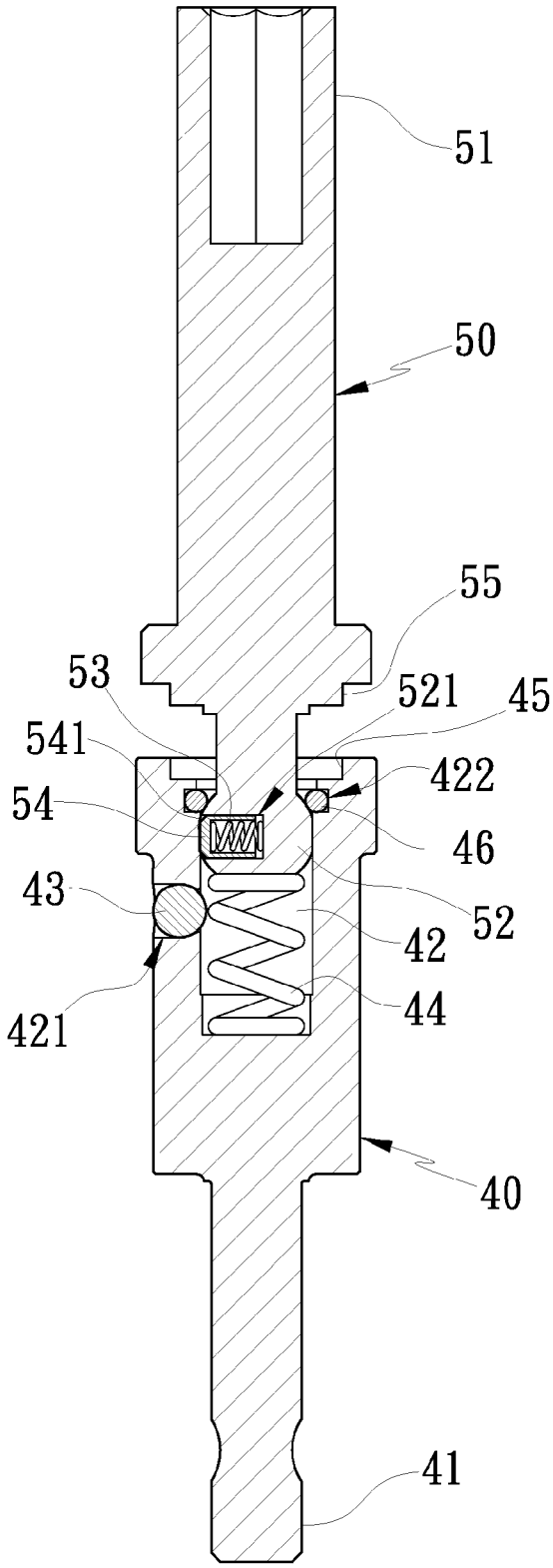
FIG. 6 is a cross sectional view showing the assembly of the tool coupling structure according to the first embodiment of the present invention.

Referring to FIGS. 4-6, a tool coupling structure in accordance with a first embodiment of the present invention comprises a first post member 40 and a second post member 50, the first post member 40 including a fitting end 41 disposed on one end thereof and a polygonal cavity 42 mounted on another end thereof, the fitting end 41 being an operating tool or a driving tool. In this embodiment, the fitting end 41 is the driving tool (such as a power tool, pneumatic tool, open end wrench, socket wrench, screwdriver handle, etc.) and is a polygonal shank or a socket, the fitting end 41 is a hexagonal shank. The cavity 42 of the first post member 40 includes a hole 421 formed on an outer wall thereof, and the hole 421 includes a biasing element 43 installed therein, the biasing element 43 is a ball to move in the hole 421 and to extend out of the outer wall of the cavity 42, the cavity 42 also includes an annular recess 422 arranged on a top end of the outer wall thereof and a first resilient element 44 received therein, and the first resilient element 44 is a spring. The second post member 50 includes a coupling end 51 disposed on one end thereof and a polygonal sphere knob 52 to be fitted to move in the cavity 42 of the first post member 40, the coupling end 51 is an operating tool or a driving tool. In this embodiment, the coupling end 51 is an operating tool (such as a socket, screwdriver bit, drill bit, etc.) and is a polygonal shank, a polygonal stem or a socket. In this embodiment, the coupling end 51 is a hexagonal stem, and the sphere knob 52 of the second post member 50 includes a notch 521 fixed on a peripheral side thereof in response to the hole 421 of the first post member 40 to receive an elastic engaging member. In this embodiment, the elastic engaging member is a spring 53 and a retaining pin 54, wherein the retaining pin 54 includes an inclined guiding plane 541 disposed on a side end thereof so that the retaining pin 54 is inserted to the hole 421 of the first post member 40 precisely. To obtain a second fitting point between a front end of the sphere knob 52 of the second post member 50 and the cavity 42 of the first post member 40, an outer diameter of the coupling end 51 is smaller than a diameter of an inscribed circle of the cavity 42. In this embodiment, the sphere knob 52 of the second post member 50 includes a tab 55 mounted on a front end thereof, and the cavity 42 includes a circular seat 45, an inner diameter of which is larger than an outer diameter of the tab 55, fixed on a front end thereof so that the tab 55 is fitted to the circular seat 55 to generate the second fitting point, and a first defining member 46 is retained to the annular recess 422 of the cavity 42 to limit the sphere knob 52 in the cavity 42 of the first post member 40.

Figure 7:
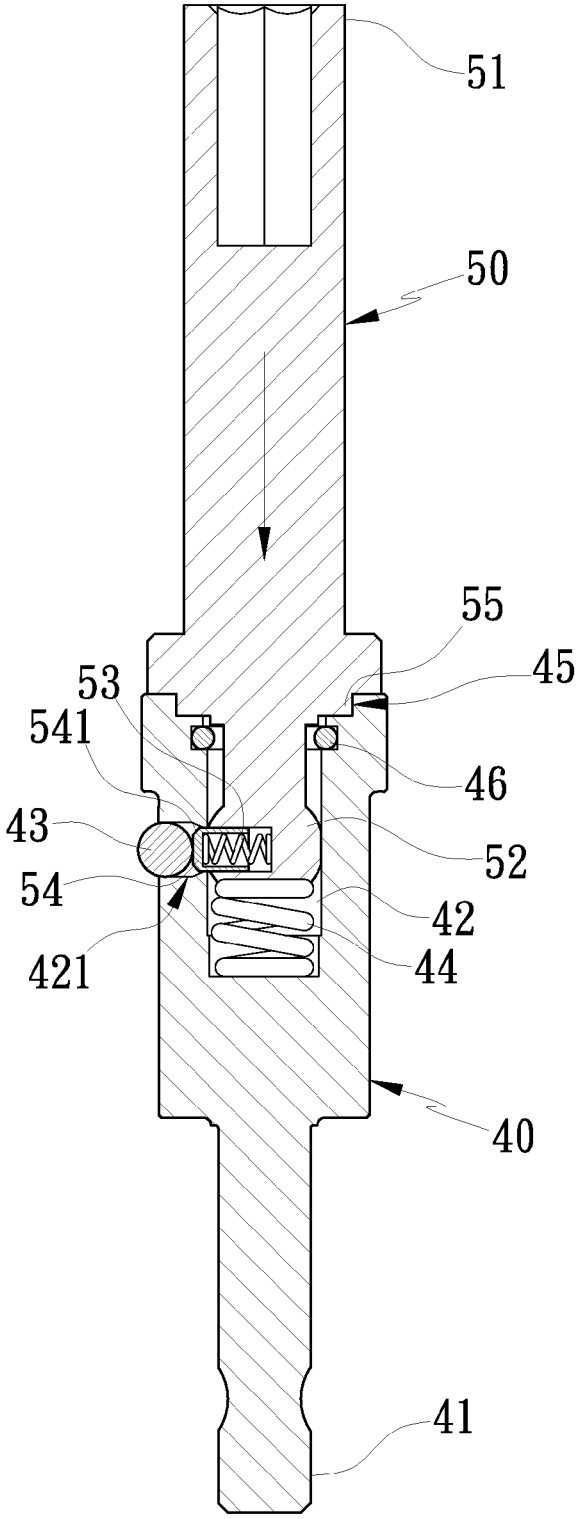
FIG. 7 is a cross sectional view showing the operation of the tool coupling structure according to the first embodiment of the present invention.

Referring to FIG. 7, the second post member 50 is pressed so that the sphere knob 52 fits to a first position of the cavity 42 of the first post member 40, and due to the engaging member of the sphere knob 52 is in response to the hole 421 of the first post member 40, the spring 53 pushes the retaining pin 54 to extend outward, and the retaining pin 54 is inserted and retained in the hole 421 of the first post member 40 by using its inclined guiding plane 541 precisely, such that the sphere knob 52 of the second post member 50 is positioned at a first position of the cavity 42, and the tab 55 of the second post member 50 is fitted to the circular seat 45 of the cavity 42 so that the first and the second post members 40, 50 are connected together linearly, and because the sphere knob 52 is positioned at the first position of the cavity 42, when user operates the driving tool, the second post member 50 does not move so that the user uses the tool safely.

Figure 8:
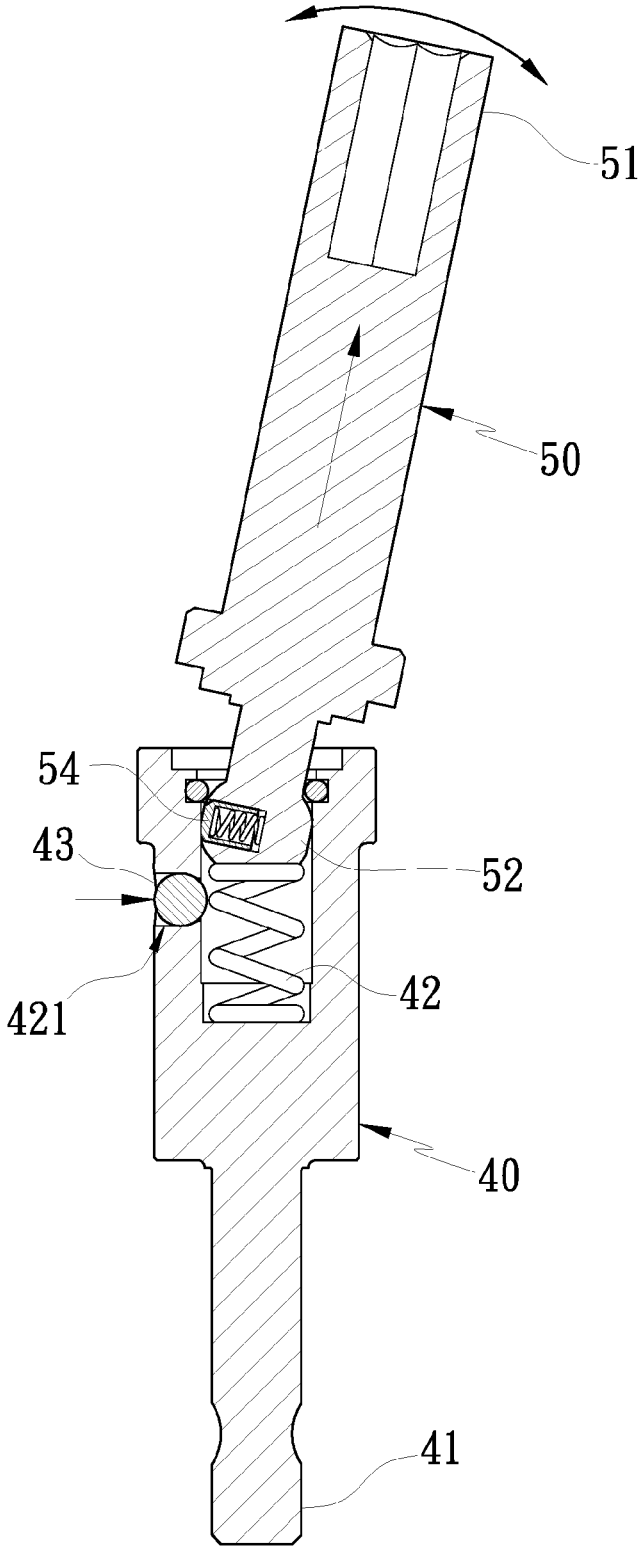
FIG. 8 is another cross sectional view showing the operation of the tool coupling structure according to the first embodiment of the present invention.

As shown in FIG. 8, the biasing element 43 of the hole 421 of the first post member 40 is pressed to extend out of the cavity 42 and to push the retaining pin 54 of the sphere knob 52 to retract inward to disengage the retaining pin 54 from the hole 421 of the cavity 42, then the first resilient element 44 pushes the sphere knob 52 of the second post member 50 to move to a second position of the cavity 42, thus rotating the sphere knob 52 to a desired angle.

Figure 9:
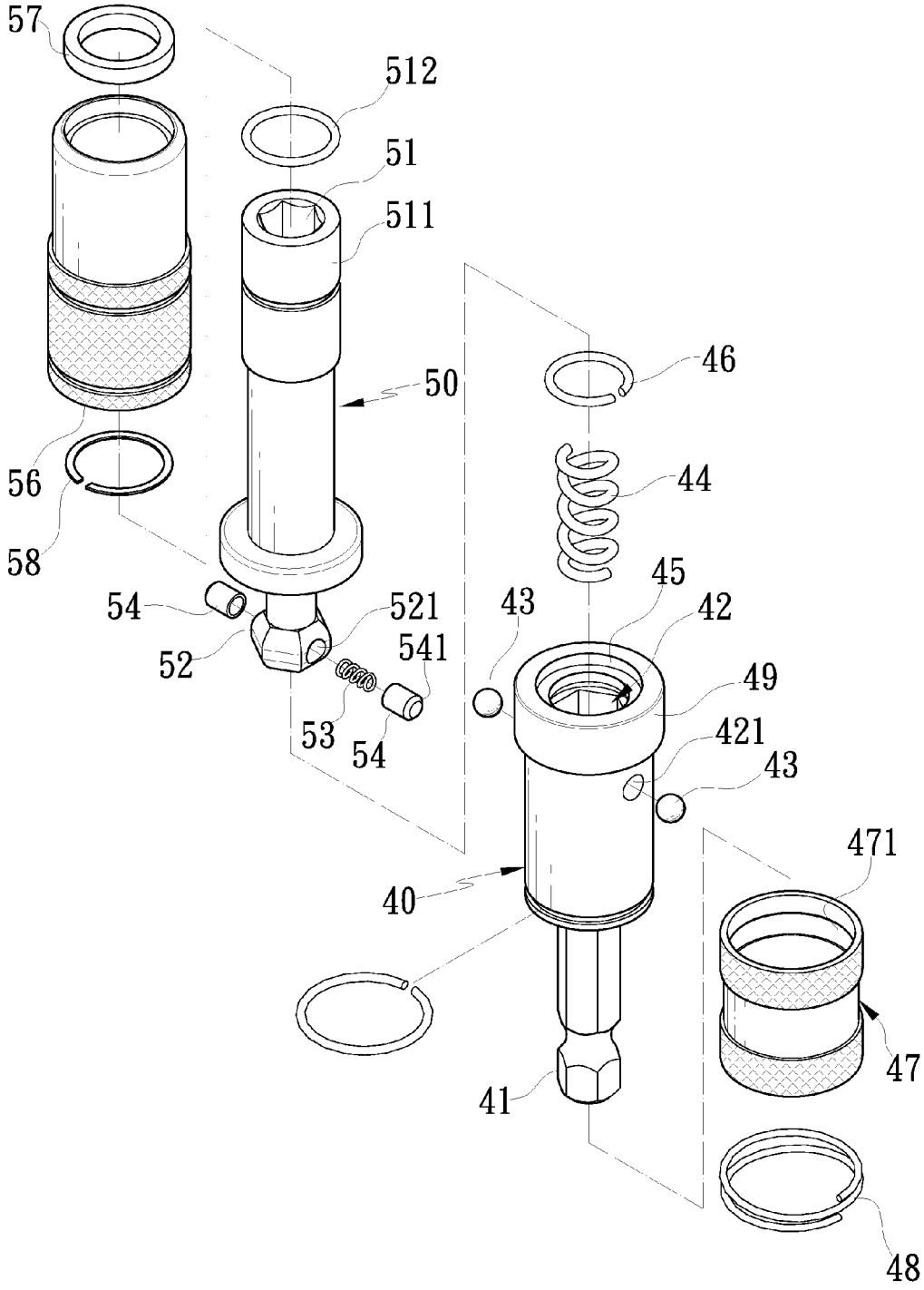
FIG. 9 is a perspective view showing the exploded components of a tool coupling structure according to a second embodiment of the present invention.
Figure 10:
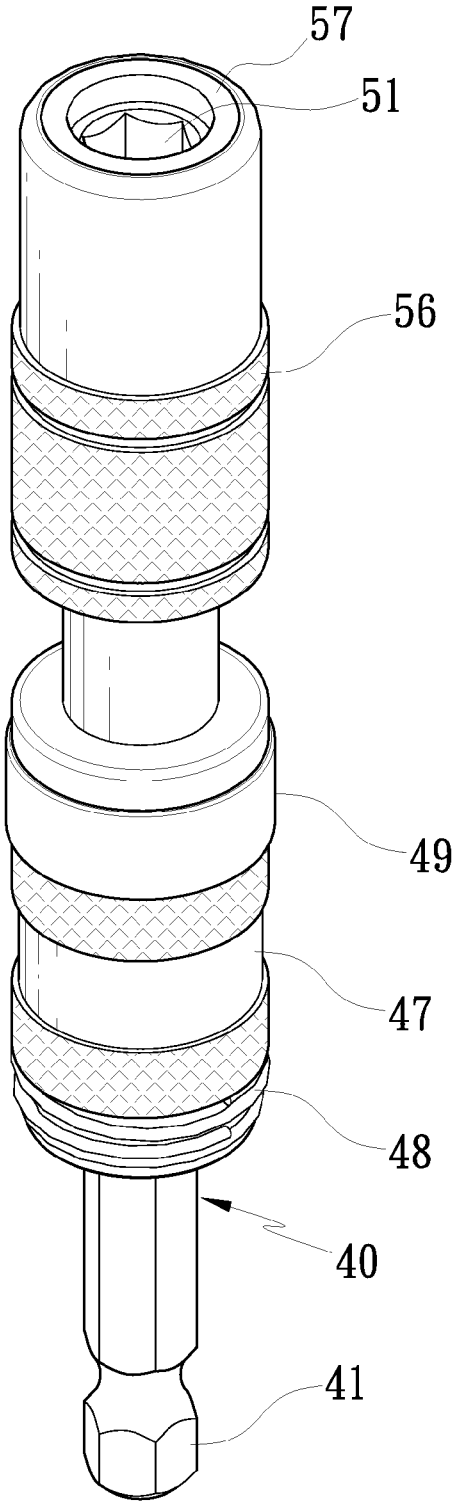
FIG. 10 is a perspective view showing the assembly of the tool coupling structure according to the second embodiment of the present invention.
Figure 11:
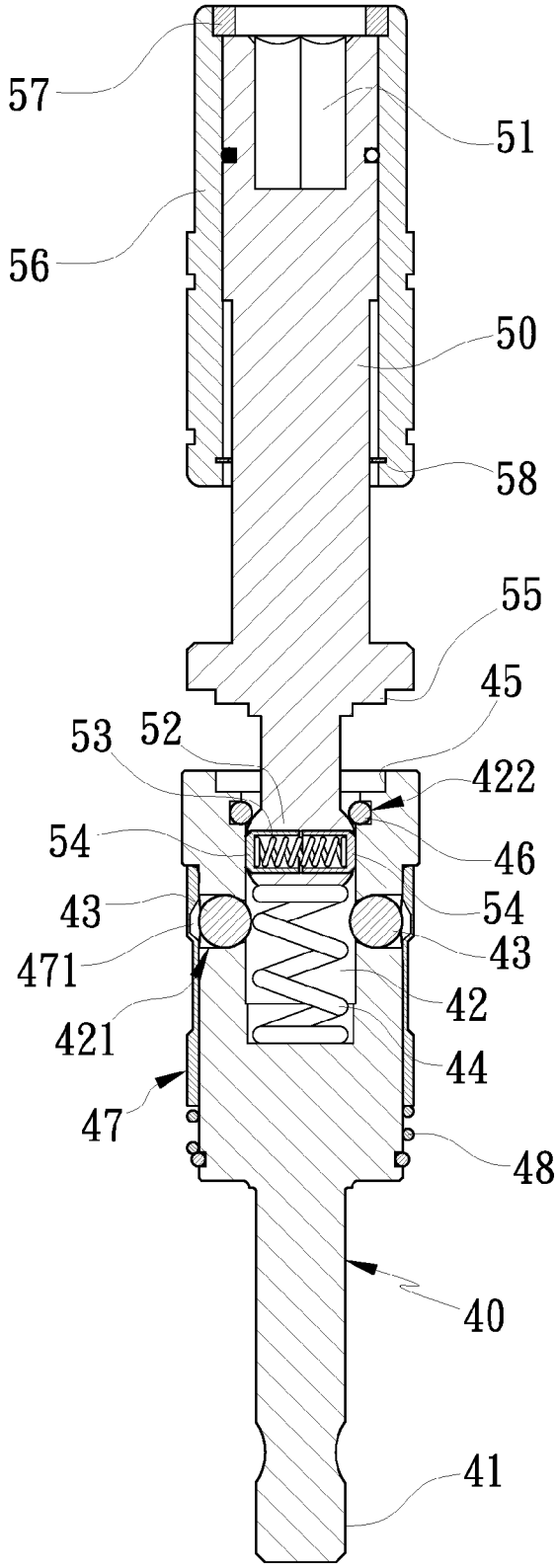
FIG. 11 is a cross sectional view showing the assembly of the tool coupling structure according to the second embodiment of the present invention.

As illustrated in FIGS. 9-11, a tool coupling structure in accordance with a second embodiment of the present invention is identical to that of the first embodiment thereof mostly, and a difference of the tool coupling structure of the second embodiment from that of the first embodiment comprises the cavity 42 of the first post member 40 includes a sliding sleeve 47 fitted on the outer wall thereof, and the sliding sleeve 47 includes a second resilient element 48 disposed on an rear end thereof and a stepped fringe 49 formed on a front end thereof so that the sliding sleeve 47 is pushed upward along the outer wall of the cavity 42, the sliding sleeve 47 also includes a chamber 471 arranged therein to receive the biasing element 43, and an inner wall of the sliding sleeve 47 abuts against the biasing element 43 so that the biasing element 43 extends out of the cavity 42, and the coupling end 51 of the second post member 50 includes a stepped fringe 511 disposed on an front edge thereof, and the stepped fringe 511 includes a circular pad 512 and a grip cover 56 fitted thereon, the grip cover 56 includes a circular magnetic member 57 mounted on a front end thereof and a second defining member 58 fixed on a suitable position of a rear end thereof. In this embodiment, the second defining member 58 is a C-shape retainer so that the coupling end 51 is fitted to the operating tool to rotate the grip cover 56 and to provide a locking effect.

Figure 12:
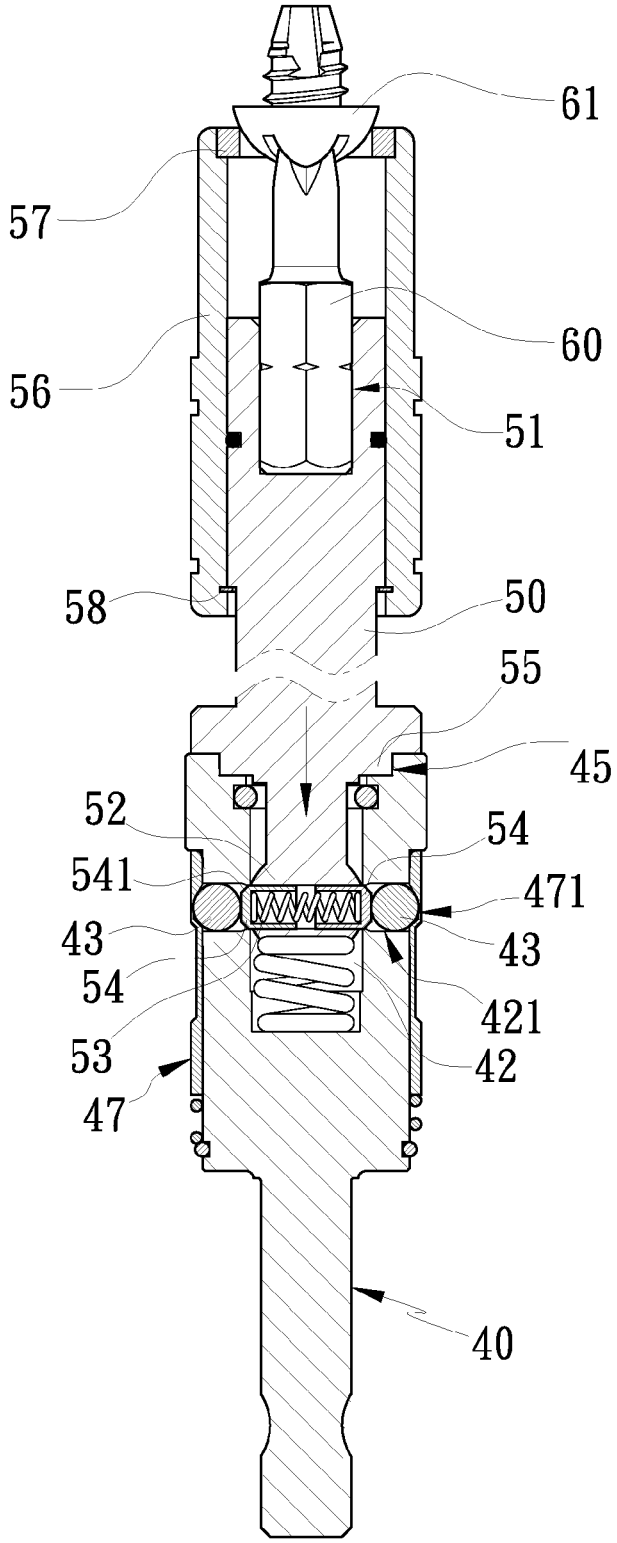
FIG. 12 is a cross sectional view showing the operation of the tool coupling structure according to the second embodiment of the present invention.

Referring to FIG. 12, the second post member 50 is pressed so that the sphere knob 52 is fitted to the first position of the cavity 42, because the engaging member of the sphere knob 52 corresponds to the hole 421 of the first post member 40, and the spring 53 pushes the retaining pin 54 to extend outward, the retaining pin 54 inserts to the hole 421 of the cavity 42 precisely by using its inclined guiding plane 541 so as to push the biasing element 43 to disengage from the cavity 42, hence the biasing element 43 is received in the chamber 471 of the sliding sleeve 47, and the sphere knob 52 of the second post member 50 is positioned at the first position of the cavity 42, the tab 55 of the second post member 50 is fitted in the circular seat 45 so that the first and the second post members 40, 50 are connected together linearly. Thereby, the sphere knob 52 of the second post member 50 is positioned at the first position of the cavity 42 so that when user operates the driving tool, the second post member 50 does not move to obtain an operating safety. Besides, an operating tool 60 (such as a screwdriver bit) is fitted to the coupling end 51 to push the grip sleeve 56 to extend outward along the second post member 50, and the magnetic member 57 of the grip cover 56 is provided to attract a locking element 61 (such as a screw bolt).

Figure 13:
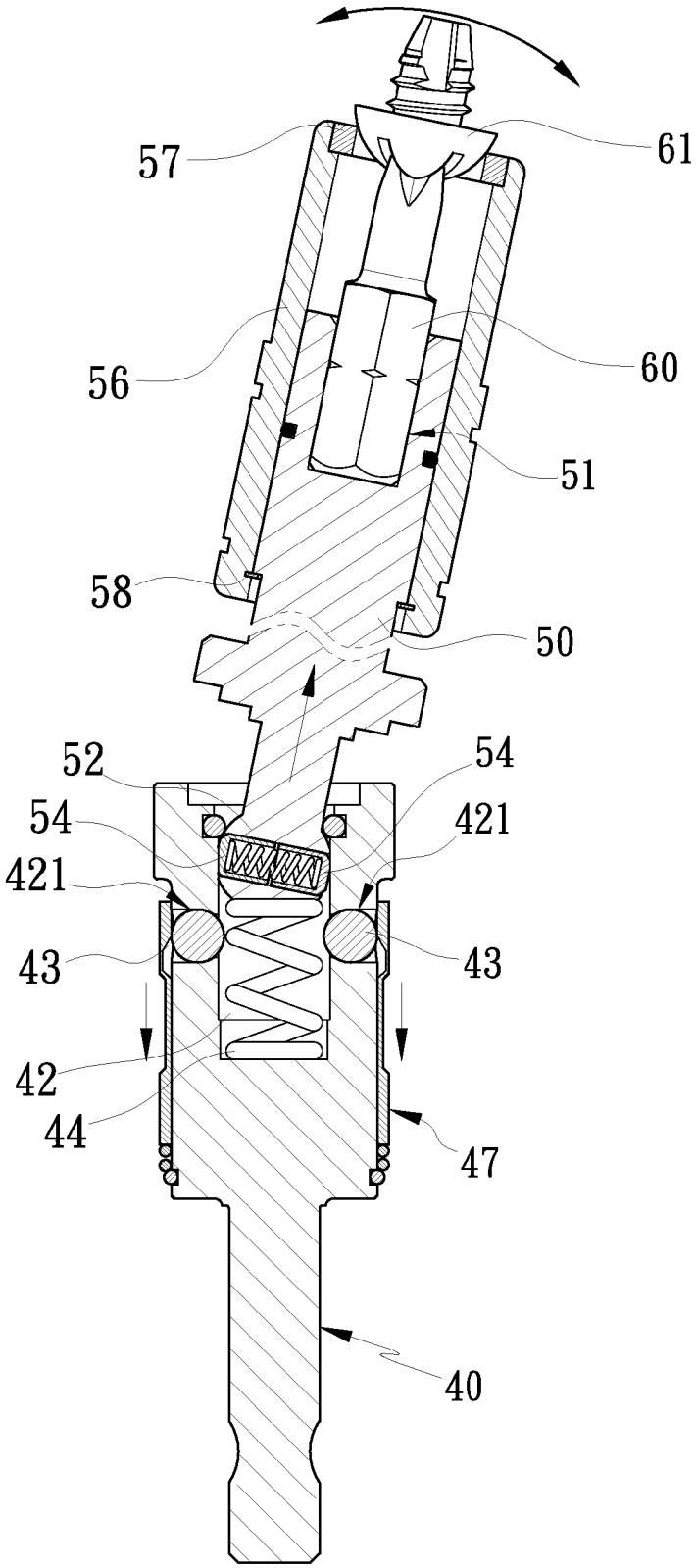
FIG. 13 is another cross sectional view showing the operation of the tool coupling structure according to the second embodiment of the present invention.

As shown in FIG. 13, the sliding sleeve 47 is pushed to abut against the biasing element 43 so that the biasing element 43 extends out of the cavity 42 to push the retaining pin 54 to retract inward, such that the retaining pin 54 disengages from the hole 421 of the first post member 40, and the first resilient element 44 of the cavity 42 pushes the sphere knob 52 of the second post member 50 to move to the second position of the cavity 42, thus rotate thing the sphere knob 52 to a desired angle easily.

The invention is not limited to the above embodiment but various modifications thereof may be made. It will be understood by those skilled in the art that various changes in form and detail may made without departing from the scope and spirit of the present invention.

What is claimed is:

1. A tool coupling structure comprising:

a first post member including a fitting end disposed on one end thereof and a polygonal cavity mounted on another end thereof; the cavity including a hole formed on an outer wall thereof, and the hole including a biasing element installed therein; a second post member including a coupling end fixed on one end thereof and a polygonal sphere knob formed on another end thereof to be fitted to the cavity of the first post member, and the sphere knob including an elastic engaging member fixed on a peripheral side thereof in response to the hole of the first post member to be retained in the hole.

2. The tool coupling structure in claim 1, wherein the biasing element is a ball to move in the hole and to extend out of the outer wall of the cavity.

3. The tool coupling structure in claim 1, wherein the cavity includes a first resilient element received therein, and the first resilient element is a spring.

4. The tool coupling structure in claim 1, wherein the sphere knob of the second post member includes a notch fixed on a peripheral side thereof in response to the hole of the first post member to receive the elastic engaging member, and the elastic engaging member is a spring and a retaining pin.

5. The tool coupling structure in claim 1, wherein the sphere knob of the second post member includes a tab mounted on a front end thereof, the cavity includes a circular seat fixed on a front end thereof, and an inner diameter of the circular seat is larger than an outer diameter of the tab so that the tab is fitted to the circular seat.

6. The tool coupling structure in claim 1, wherein the cavity also includes an annular recess arranged on a top end of the outer wall thereof and a first resilient element received therein.

7. The tool coupling structure in claim 1 further comprising the cavity of the first post member including a sliding sleeve fitted on the outer wall thereof, and the sliding sleeve including a second resilient element disposed on an rear end thereof and a stepped fringe formed on a front end thereof so that the sliding sleeve is pushed upward along the outer wall of the cavity, the sliding sleeve also including a chamber arranged therein to receive the biasing element, and an inner wall of the sliding sleeve abutting against the biasing element so that the biasing element extends out of the cavity.

8. The tool coupling structure in claim 7, wherein an inner wall of the sliding sleeve abuts against the biasing element so that the biasing element pushes the retaining pin to retract inward.

9. The tool coupling structure in claim 1 further comprising the second post member including a grip cover fitted thereon, the grip cover including a circular magnetic member mounted on a front end thereof and a second defining member fixed on a suitable position of a rear end thereof.

* * * * *